United States Patent [19]

Nakane et al.

[11] Patent Number: 4,790,456

[45] Date of Patent: Dec. 13, 1988

[54] MATERIAL SUPPLY EQUIPMENT FOR VISCOUS FLUID PRESSURE FEED SYSTEM

[75] Inventors: Yasuji Nakane; Yoshihumi Fujii, both of Tokyo, Japan

[73] Assignee: Three Bond Co., Ltd., Tokyo, Japan

[21] Appl. No.: 783,470

[22] Filed: Oct. 3, 1985

[30] Foreign Application Priority Data

Oct. 6, 1984 [JP] Japan ..... 59-151445[U]

[51] Int. Cl.[4] ..... B65D 88/60

[52] U.S. Cl. ..... 222/183; 222/259; 222/260; 222/327; 222/386

[58] Field of Search ..... 222/183, 260, 261, 257, 222/326, 327, 105, 405, 189, 381, 259; 425/197; 141/357

[56] References Cited

U.S. PATENT DOCUMENTS

| | | | |
|---|---|---|---|
| 1,981,495 | 11/1934 | Butler | 141/357 |
| 2,013,273 | 9/1935 | Jonsson | 222/259 |
| 2,443,981 | 6/1948 | Funk et al. | 222/259 |
| 2,517,551 | 8/1950 | Eckman | 141/357 |
| 2,601,169 | 6/1952 | Purvis | 141/357 |
| 2,636,658 | 4/1953 | Baumer et al. | 141/357 |
| 2,671,579 | 3/1954 | Knoblock | 222/92 X |
| 3,096,912 | 7/1963 | Rivette | 222/105 X |
| 3,456,849 | 7/1969 | Sjostrand | 222/327 X |
| 3,817,377 | 6/1974 | Piggott | 425/197 X |
| 3,904,083 | 9/1975 | Little | 222/326 X |
| 3,951,462 | 4/1976 | De Francisci | 222/405 X |
| 4,195,755 | 4/1980 | Slautterback et al. | 222/260 X |

FOREIGN PATENT DOCUMENTS

| | | | |
|---|---|---|---|
| 460363 | 10/1949 | Canada | 141/357 |

*Primary Examiner*—Joseph J. Rolla
*Assistant Examiner*—Nils E. Pedersen
*Attorney, Agent, or Firm*—Donald D. Mon

[57] ABSTRACT

Material Supply Equipment in which a cylindrical container constructed with a substantially straight side all the way to the bottom receives a plastic bag filled with a high viscosity fluid to be pumped. A planar cover plate for the container has an outer diameter closely fitting the inside surface of the container to press the plastic bag therebetween and has a central suction hole. A suction pump is provided having a planar suction plate which can be lowered onto the planar cover plate. The planar suction plate has a plurality of suction holes which register with the central hole of the cover plate encircled by an "O" ring groove and "O" ring to prevent dripping and infusion of air, respectively.

2 Claims, 3 Drawing Sheets

MATERIAL SUPPLY EQUIPMENT FOR VISCOUS FLUID PRESSURE FEED SYSTEM

FIELD OF THE INVENTION

This invention relates to a material supply equipment for viscous fluid pressure feed system.

BACKGROUND OF THE INVENTION

Viscous fluids, such as sealing materials, bonding agents, and greases, are conventionally enclosed in a polyethylene bag, which is contained in a pail can for storage and transportation. Previously, as shown in FIG. 4, the pail can 3 which contains the polyethylene bag 2 filled with the viscous fluid 1 is put on to a base 4. A suction pump 6 held by a lifting unit 5 is provided over the pail can 3. The suction pump has a suction inlet at a lower end thereof. The suction inlet is provided with a follower plate 7, which has a rubber wiper 8 around the edge thereof. The rubber wiper 8 is inserted inside of the polyethylene bag 2 in the pail can 3 so as to press down on the upper surface of the viscous fluid 1. Then, the suction pump sucks and feeds the viscous fluid to a coating unit and similar units.

In the above-stated way, the lifting unit 5 lowers the suction pump 6, follower plate 7 and rubber wiper 8 as the viscous fluid 1 is sucked out and the upper surface thereof in the pail can 3 decreases. When descending, the rubber wiper 8 wipes off the viscous fluid 1 on the inside of the polyethylene bag 2. FIG. 5 shows rubber wiper 8 at a lower limit of the pail can 3. As seen from the figure, some amount of viscous fluid 1*a* remains in the polyethylene bag 2 which could not be sucked fully out. This results from the cone shape of follower plate 7 the opening of which directed downward and from the fact that connection of the side wall of the pail can 3 and bottom thereof is curved to such a degree that the rubber wiper 8 cannot reach the bottom.

In addition, the wiper 8 must be made of rubber because the pail can 3 does not always have precise dimensions and might be deformed. Even the rubber wiper 8 is defective in that viscous fluid 1*b* can leak out and adhere to the upper side thereof. For the reason, the rubber wiper 8 must be cleaned or replaced when the pail can 3 is replaced.

Further, when the lifting unit 5 raises up the suction pump 6, the follower plate 7, and the rubber wiper 8 for replacing the pail can 3, the viscous fluid 1*a* residing on the bottom of the follower plate can drip as shown in FIG. 6. This can not only contaminate the working place, but also the follower plate 7 will enclose a substantial amount of air below the concave surface thereof when lowered down into the next pail can. This can cause problems in feeding the viscous fluid.

It is an object of the present invention to provide material supply equipment which reduces to a minimum the amount of residual viscous fluid that cannot be sucked.

Another object of the present invention is to provide material supply equipment which minimizes contamination of a working place and mixing of air caused by replacing a pail can.

BRIEF DESCRIPTION OF THE INVENTION

The material supply equipment of this invention consists chiefly of a specifically-designed cylindrical container which is used instead of a conventional pail can having a viscous fluid put in together with a polyethylene bag, an inside cover plate, and a suction plate which is pressed downward an the inside cover plate. The suction plate has numerous of small suction holes to suck up the viscous fluid.

The inside cover plate is planar as is the bottom of the cylindrical container. Connection of the side wall of the cylndrical container and the bottom thereof is straight rather than curved, as in the conventional pail can. The inside cover plate therefore closely fits the bottom of the cylindrical container allowing the viscous fluid to be sucked up completely. This results in minimum residual viscous fluid and virtually prevents the mixing of air when the numerous cylindrical container is replaced. The small suction holes prevent the viscous fluid on the lower surface of the inside cover plate from dripping.

The above and other features of this invention will be fully understood from the following detailed description and the accompanying drawings, in which:

BRIEF DESCRIPTION OF THE DRAWINGSS

DETAILED DESCRIPTION OF THE INVENTION

Figure 1:
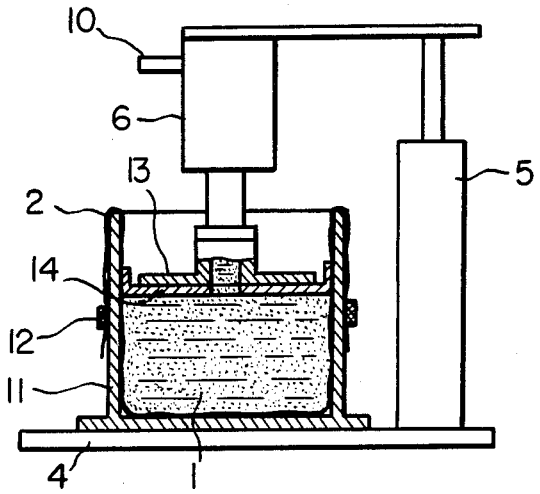
FIG. 1 is a sectional view of material supply equipment of the present invention.
Figure 2:
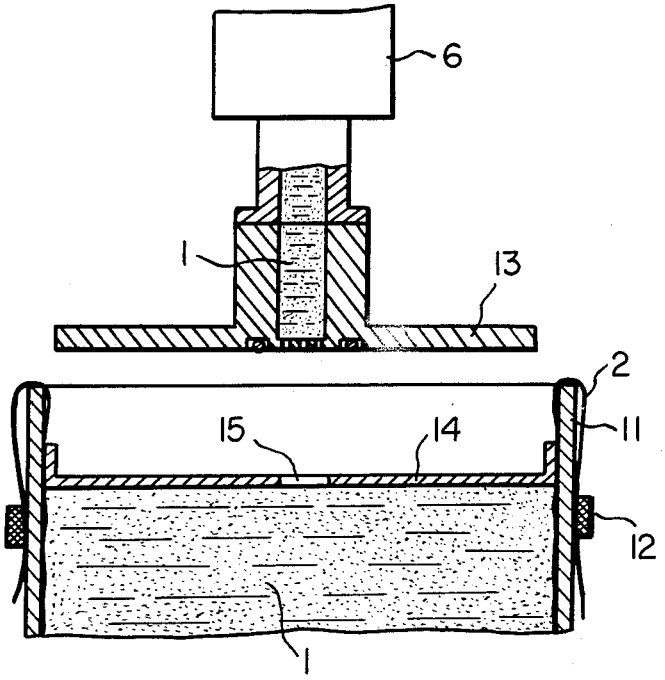
FIG. 2 is a sectional view of a major portion of the material supply equipment of the present invention.
Figure 3:
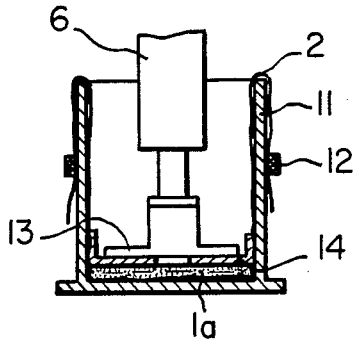
FIG. 3 shows how viscous fluid is completely sucked up by the material supply equipment of the present invention.
Figure 4:
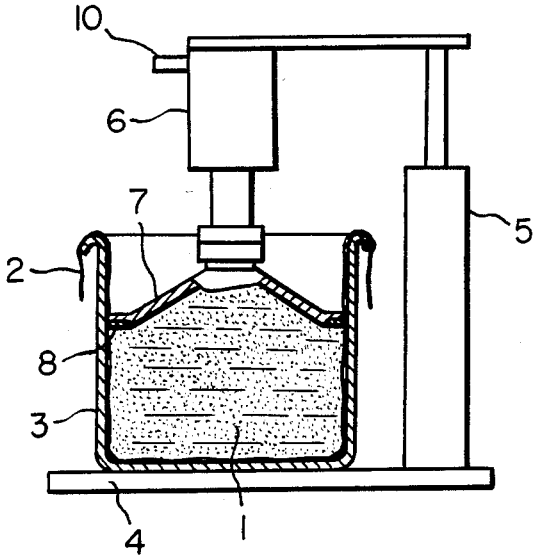
FIG. 4 (PRIOR ART)
FIG. 4 is a sectional view of a prior art device.
Figure 5:
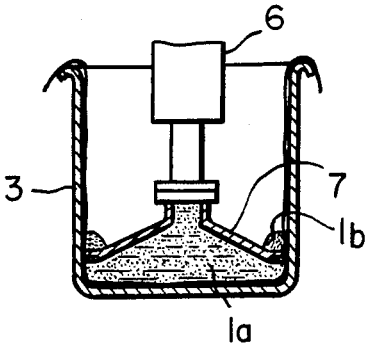
FIG. 5 (PRIOR ART)
FIG. 5 shows how viscous fluid is sucked up by a prior art device.
Figure 6:
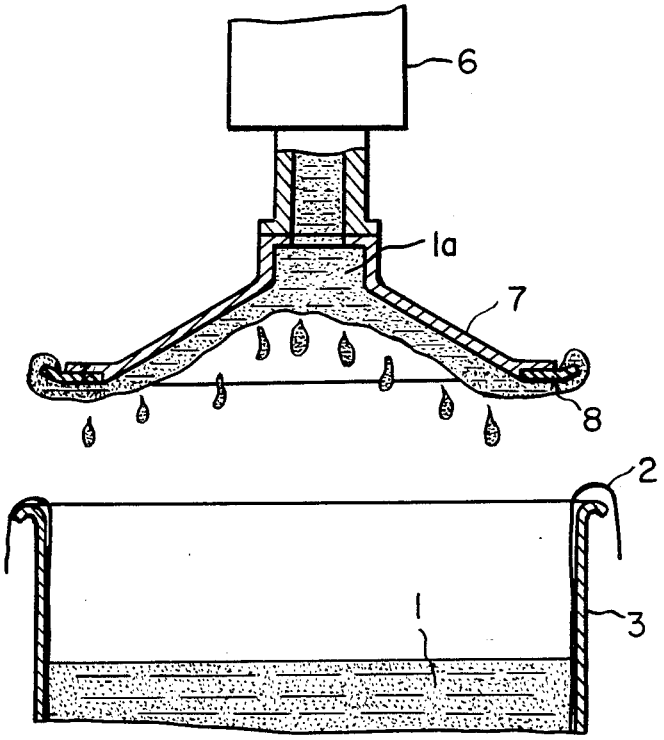
FIG. 6 (PRIOR ART)
FIG. 6 shows the condition of the prior art device when a pail can has been replaced.

Material supply equipment of this invention is schematically shown in FIGS. 1, 2, and 3. A base 4 has a cylindrical container 11 put in position. The cylindrical container 11 receives a polyethylene bag 2 filled with viscous fluid 1. The edge of the polyethylene bag 2 is folded down on the outside of the cylindrical container 11 and is held in place on the outside by fasteners 12.

The base 4 has a lifting unit 5 mounted thereon. The lifting unit 5 holds a suction pump 6 right above the cylindrical container 11. At the suction opening of the suction pump 6 a suction plate 13 is held parallel to upper surface of the base 4. A central area the suction plate 13 has multiple of small holes closely spaced on a circle so that the viscous fluid 1 can enter the suction opening. The suction plate 13 has outside the circle of small holes a groove, for receiving an "O" ring.

A circular inside cover plate 14 is placed on top of the viscous fluid 1 in the polyethylene bag 2 put in the cylindrical container 11. The outer diameter of the inside cover plate 14 is selected so that it will slide along inside of the polyethylene bag 2 and be pressed against the inside of the cylindrical container 11. The inside cover plate 14 has one or more suction holes 15 at the center area thereof matching the small holes on the center area of the suction plate 13, respectively. The inside cover plate 14 may be planar of if desired or the, edge thereof may be folded bend upwards so as to slide along the inside of the cylindrical container 11.

When the viscous fluid 1 decreases by being sucked by the suction pump 6, the lifting unit 5 lowers the suction pump 6, the suction plate 13, and the inside cover plate 14 which is pressed down on the top of the viscous fluid 1. The inside cover plate 14 can be pressed down completely to the bottom of the cylindrical container 11 as the shape of cylindrical container 11 is cylindrical down to the bottom. For this reason, little viscous fluid 1 remains when the inside cover plate 14 is pressed down completely to the bottom.

The cylindrical container 11, unlike the conventional pail can, is precisely fabricated. This means that the inside cover plate 14 needs no rubber wiper, as the aforesaid follower plate did. This feature is advantageous in that the viscous fluid 1 cannot leak out around the inside cover plate 14.

Suction openings in suction plate 13 consists of multiple of small holes. The viscous fluid remaining in the small holes cannot drip when lifted up for replacing the cylindrical container 11.

The suction plate 13 and upper and lower sides of the inside cover plate 14 are planar. The said "O" ring shuts off outside air. These features minimize possible mixing of air when the cylindrical container 11 is replaced.

This invention is not to be limited by the embodiment shown in the drawings and described in the description, which are given by way of example and not of limitation, but only in accordance with the scope of the appended claims.

We claim:

1. In a pressure feed system for feeding high-viscosity fluids by sucking the fluid from a polyethylene bag placed in a container with a suction pump, material supply equipment for said viscous fluid pressure feed system comprising:

a cylindrical container having a constant diameter substantially to the bottom thereof, the bottom being substantially planar:

a planar inside cover plate matching the planar surface of the bottom of said container having a peripheral surface closely fitting the inside surface of said container to tightly press said polyethylene bag against the interior of said container when said planar inside cover plate is inserted in said container; said planar inside cover plate having a plurality of small central suction holes;

a planar suction plate secured to a lower end of said suction pump; a lower surface of said planar suction plate mating with, closely fitting, and substantially covering the upper surface of said planar inside cover plate; said planar suction plate having a plurality of small centrally located suction holes in registration with said plurality of small central suction holes in said planar inside cover plate;

suction pump lifting and lowering means adapted to press said planar suction plate down on said planar inside cover plate when said pump is lowered;

an O-ring groove in said planar suction plate encircling said plurality of small central suction holes, and an O-ring seated in said groove to minimize infusion of air beneath said planar inside cover plate; and fastening means for fastening an upper edge portion of said polyethylene bag overlapping and folding down around the outside of said cylindrical container in place.

2. The material supply equipment according to claim 1 in which said peripheral surface on said planar inside cover plate is deformable so that said planar inside cover plate squeezes said polyethylene bag between said outer periphery and the inside surface of said cylindrical container.

* * * * *